United States Patent [19]

Friz

[11] 4,241,697

[45] Dec. 30, 1980

[54] LAMINATING DEVICE

[75] Inventor: Helmut A. Friz, Stuttgart, Fed. Rep. of Germany

[73] Assignee: Paliv AG, Chur, Switzerland

[21] Appl. No.: 906,124

[22] Filed: May 15, 1978

[30] Foreign Application Priority Data

May 18, 1977 [DE] Fed. Rep. of Germany ..... 2722593

[51] Int. Cl.[3] ..... B05C 9/10

[52] U.S. Cl. ..... 118/713; 118/70; 118/126; 427/358

[58] Field of Search ..... 427/356, 358; 118/230, 118/231, 235, 413, 253, 120, 122, 126, 223

[56] References Cited

U.S. PATENT DOCUMENTS

| | | | |
|---|---|---|---|
| 2,054,113 | 9/1936 | Abrams et al. | 427/358 |
| 2,704,530 | 3/1955 | Nilsen et al. | 118/253 |
| 3,014,454 | 12/1961 | Smejda | 118/126 |
| 3,335,702 | 8/1967 | Pulfer | 118/126 |
| 3,641,978 | 2/1972 | Hathorn | 118/413 |

FOREIGN PATENT DOCUMENTS

| | | | |
|---|---|---|---|
| 698518 | 11/1964 | Canada | 427/356 |
| 916768 | 1/1963 | United Kingdom | 118/126 |

OTHER PUBLICATIONS

Litzler, Surface Coating and Impregnation of Fabric, Rubber Age, Jul. 1952, pp. 501-506.

*Primary Examiner*—Ralph S. Kendall

*Attorney, Agent, or Firm*—Price, Heneveld, Huizenga & Cooper

[57] ABSTRACT

A laminating device for the application of coating to sheet material includes a doctor blade and a bearing surface between which the material to be coated is passed. The bearing surface has a convex curvature whereby the area of the contact zone between the sheet material and bearing surface is minimized. Means is also provided for horizontal and vertical adjustment of the bearing surface.

24 Claims, 3 Drawing Figures

LAMINATING DEVICE

Figure 1:
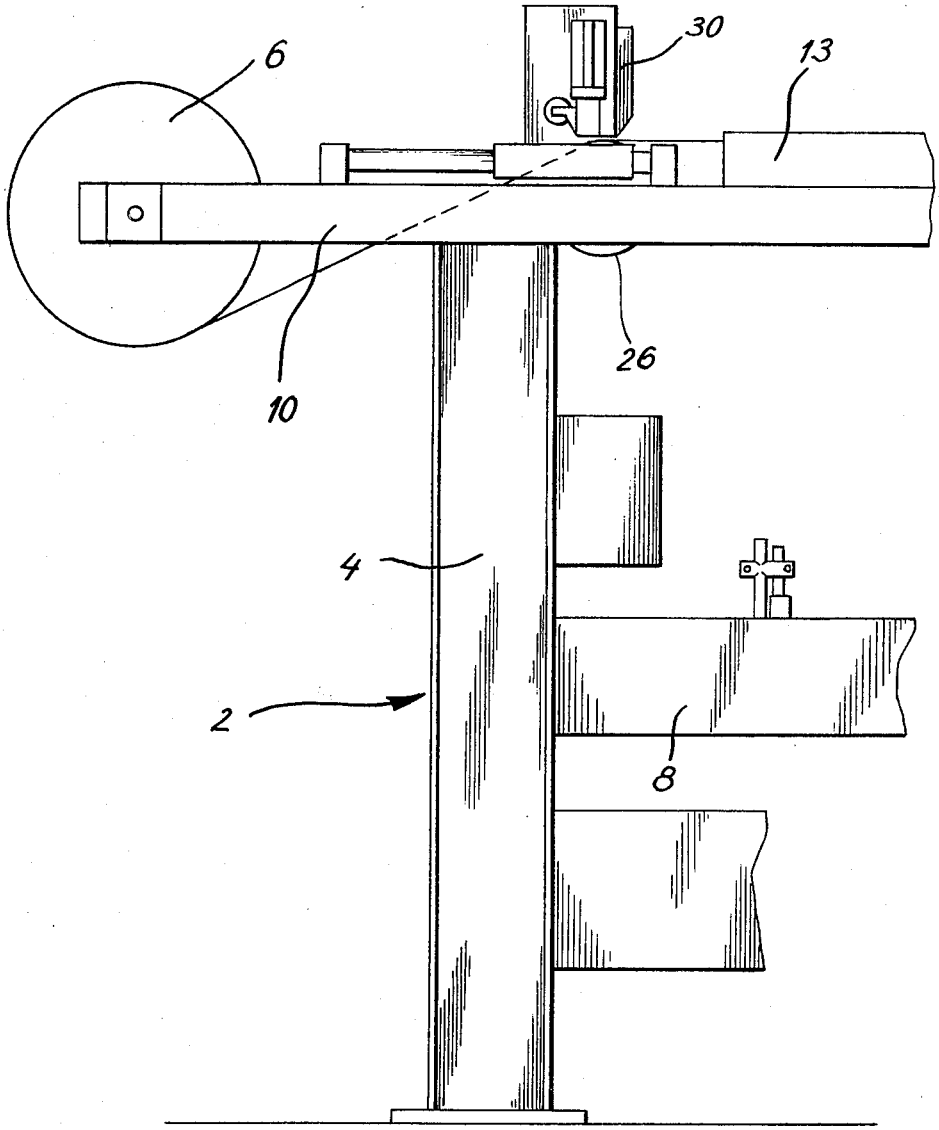

The invention relates to a laminating device of the type in which a doctor blade cooperates with a bearing surface to apply a coating to a continuous web of material passing between the doctor blade and the bearing surface.

Laminating devices carry adhesive doctor blades for coating the sheets which are to be laminated to the workpieces. For this purpose, the sheet runs beneath the doctor blade across a bearing surface. The distance between the doctor blade outlet gap and the sheeting surface determines the thickness of the adhesive applied. On known laminating devices, the bearing surface is flat; between the doctor blade underside and the bearing surface, there is formed a relatively long narrow gap, across whose entire length the sheet rests. When the sheet is pulled through, there are thus formed relatively strong frictional forces which may cause sensitive sheeting to be torn. Contamination accumulating inside the long gap also causes damage to the sheeting. Due to the flat guide, it is impossible to smooth wavy or bulgy sheeting properly, as would be necessary for a uniform coating with adhesive. The fact that it is possible for adhesive to run beyond the sheet edges onto the bearing surface is a particularly obstructive feature of the known laminating devices. If this happens, the go-side of the sheet is contaminated. The laminating process has therefore to be interrupted, the doctor blade has to be swung away and the bearing surface has to be cleaned.

It is the object of the present invention to provide a laminating device of the kind mentioned at the beginning wherein the frictional forces acting between the sheeting and the bearing surface are reduced and the risk of damage being caused by contamination accumulating between the doctor blade and the bearing surface is diminished; at the same time, it should be possible to smooth wavy sheet webs.

Due to the curved design of the bearing surface according to the invention, the length of the contact zone between the sheet and the bearing surface is reduced. This diminishes both the frictional forces and the danger of damage caused by contamination. The sheet can be pulled across the curved bearing surface in such a way that components of stress act in the direction of the bearing surface. This causes it to be smoothed in the area beneath the doctor blade, which results in a more uniform application of adhesive.

If the bearing surface is designed as a roller, the bearing surface disposed beneath the doctor blade can be renewed without any interruption in the operation of the device. Contaminated surfaces can be cleaned while the device is operated. The distance between the doctor blade and the bearing surface can be easily varied by the appropriate adjustment of the roller axle. If the roller rotates freely round its axle or if it is even driven, then the frictional forces acting on the sheeting web are further reduced.

Figure 2:
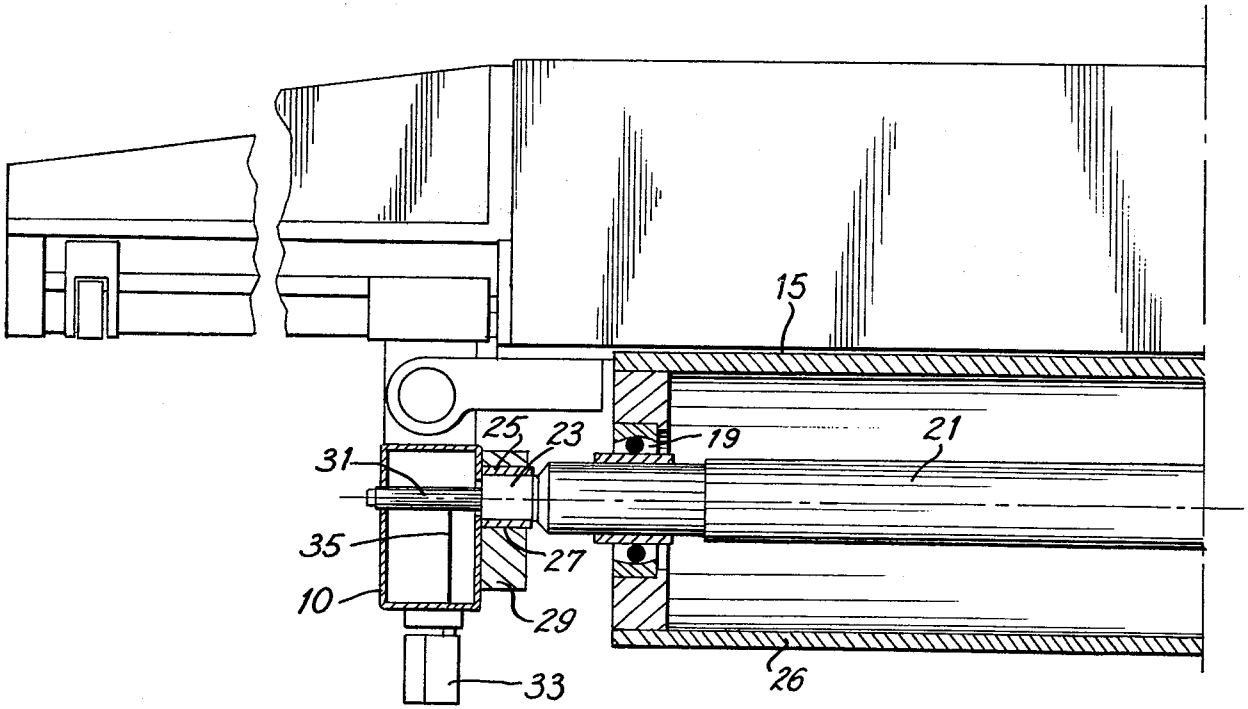
Figure 3:
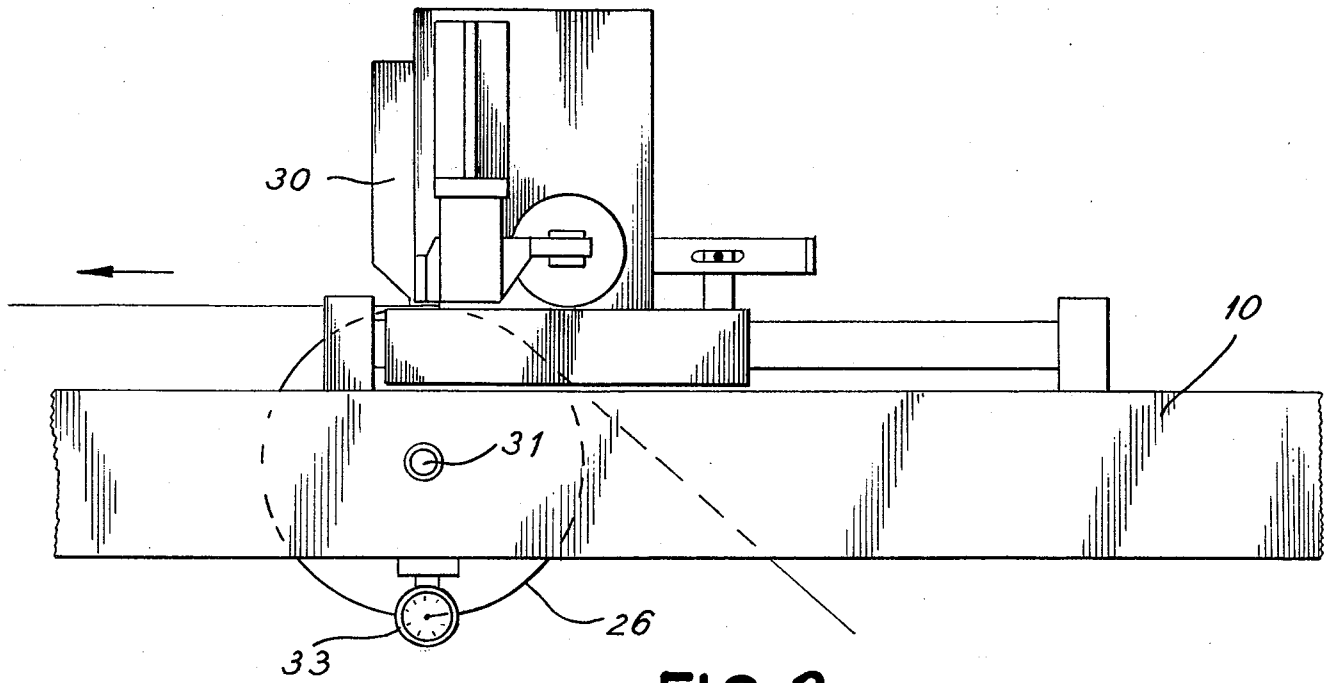

Some exemplified embodiments of the invention will be explained in more detail hereafter with reference to the drawings, in which:

FIG. 1 diagrammatically shows the end of a laminating device according to the invention at the doctor blade end;

FIG. 2 shows a detail of the doctor blade area, partly in section (half the device side); and FIG. 3 shows a lateral view in respect of FIG. 2.

The end of a laminating device at the doctor-blade end is diagrammatically shown in FIG. 1. The laminating device comprises a frame 2 with vertical supports 4, several cross beams (not shown) as well as upper and lower longitudinal beams 10 and 8. The lower longitudinal beams 8 carry driving rollers or wheels (not shown) for the workpiece to be laminated as well as suitable tools for pressing the sheet against the workpiece.

At the end of the upper longitudinal beams 10 that is to the left in the drawing, there is located a reel 6, from which the sheet to be laminated is drawn. With the side to be glued upwards, the sheet is passed beneath an adhesive doctor blade 30, where it rests on a table still to be described. The doctor blade 30 applies adhesive which is partly dried as the sheet is moved on through a ventilation channel 13. At the right-hand end of the laminating device which is not shown, the sheet is deflected towards the lower longitudinal beams 8, where it impinges on the workpieces arriving from the right-hand side in the drawing.

Together with the workpiece, the sheet moves along the lower longitudinal beams 8 back to the left. During this passage, it is pressed against the workpiece in known manner and may be folded over.

As can be seen particularly clearly in FIGS. 1 and 3, the bearing surface 15 for the sheet beneath the doctor blade 30 is curved upwardly. By this means, two aims are achieved: On the one hand, the length of the surface on which the sheet rests is not as large as it is on conventional laminating devices having a flat bearing table. This reduces the friction acting on the sheet. At the same time, the danger that contamination accumulating in the gap between the doctor blade 30 and the bearing surface 15 will cause the sheet to be torn is lessened.

On the other hand, the sheet can be guided across the curved bearing surface 15 in such a way that a component of stress extends towards the bearing surface 15. This allows a wavy or bulgy sheet to be smoothed, whereby the uniformity of the adhesive application is improved.

The bearing surface 15 may be a stationary element which is fixed to the machine. However, it is preferably designed as a roller 26, as shown in the drawings. The roller 26 runs through a ball bearing 19 on an axle 21, whose position can be varied relative to the frame 2, and thus to the outlet gap of the doctor blade 30, in a manner still to be described.

When relatively thick sheeting is used, where the frictional forces arising between the sheet and the bearing surface 15 have no damaging effect, the roller 26 is fixed so that it does not rotate round the axle 21. If the application width of the doctor blade 30 has been set by mistake so that it is too wide, causing adhesive to run beyond the lateral edges of the sheet onto the bearing surface 15, all that needs to be done is to rotate the roller by a short length. A new clean bearing surface will then be provided for the sheet without any interruption of the operation of the device.

The roller 26 is arranged in the device in such a way that it is accessible from at least one side, even while the laminating device is in operation. This allows the contaminated roller surface to be cleaned. It is also possible to perform this cleaning operation automatically by means of a suitable device, past which the roller surface sweeps during the rotary movement of the roller 26.

When thin sheeting is used, it may be recommendable, for a reduction of the frictional forces acting thereon, to unlock the roller 26 and to allow it to revolve freely round its axle 21.

When even more sensitive sheeting is used, particularly such which is attacked by the solvent in the adhesive, it is also possible to drive the roller 26 externally.

The thickness of the adhesive applied is determined by the distance between the doctor blade 30 and the bearing surface 15 (at a given sheet thickness). As can be seen particularly clearly in FIG. 2, the upper surface of the roller 26 lies substantially beneath the outlet gap of the doctor blade 30. The distance between the outlet gap of the doctor blade 30 and the bearing surface 15 disposed therebeneath can thus be varied by the vertical or horizontal displacement of the axle 21.

In the preferred constructional form shown, the axle 21 of the roller 26 is adjusted by means of an eccentric guide. For this purpose, there is secured on a lateral section 23 of the axle 21 an eccentric sleeve 25, whose external cylindrical surface is not coaxial to the inner cylindrical surface resting against the section 23. The outer cylindrical surface of the eccentric sleeve 25 slides in a complementary bore 27 of a block 29 which is secured to the longitudinal beam 10. A lateral shoulder 31 of the axle 21 is passed through the upper longitudinal beam 10 and can be rotated from the outside. Due to the eccentricity of the sleeve 25, the position of the axle 21, and thus the distance between the outlet gap of the doctor blade 30 and the bearing surface 15, is changed during this rotary movement. By this means, the thickness of the application of adhesive can be regulated.

The position of the axle 21 of the roller 26 can be checked by a dial gauge 33 which is arranged on the longitudinal beam 10 beneath the axle shoulder 31 and whose sensing element 35 rests against the shoulder 31.

I claim:

1. A laminating apparatus for applying a coating to a web of sheet material wherein the web is drawn between an elongated doctor blade and an elongated bearing surface, said doctor blade and bearing surface being carried by a supporting framework for relative vertical movement whereby to vary the thickness of the applied coating, characterized in that said bearing surface has a convex curvature and in that means are provided for mounting said bearing surface on the supporting framework for vertical adjustment.

2. The laminating apparatus of claim 1 wherein said bearing surface comprises an elongated roller member having a generally centrally located shaft extending from at least one end thereof, means mounting said shaft to said framework, said mounting means including vertical adjustment means on said shaft and said frame.

3. The laminating apparatus of claim 2 wherein said vertical adjustment means includes eccentric guide means on said shaft and said frame.

4. The laminating apparatus of claim 3 wherein said eccentric guide means includes a sleeve member positioned on a lateral section of said shaft, and wherein the outer cylindrical surface of said sleeve which is not coaxial to the inner surface thereof, is mounted in a complementary bore of a part which is fixed to said frame.

5. The laminating apparatus of claim 4 and further including indicator means associated with said shaft to indicate the relative position of said bearing surface with respect to said doctor blade.

6. The laminating apparatus of claim 2 wherein said roller member is selectively rotatable about said shaft whereby the surface of said bearing surface in juxtaposition with said doctor blade is horizontally adjustable.

7. The laminating apparatus of claim 2 wherein said roller is rotatably mounted on said shaft.

8. The laminating apparatus of claim 7 wherein said vertical adjustment means includes eccentric guide means on said shaft and said frame.

9. The laminating apparatus of claim 8 wherein said eccentric guide means includes a sleeve member positioned on a lateral section of said shaft, and wherein the outer cylindrical surface of said sleeve which is not coaxial to the inner surface thereof, is mounted in a complementary bore of a part which is fixed to said frame.

10. The laminating apparatus of claim 9 and further including indicator means associated with said shaft to indicate the relative position of said bearing surface with respect to said doctor blade.

11. A laminating apparatus for applying a coating to a web of sheet material wherein the web is drawn between an elongated doctor blade and an elongated bearing surface, said doctor blade and bearing surface being carried by a supporting framework for relative vertical movement whereby to vary the thickness of the applied coating, characterized in that said bearing surface has a convex curvature and comprises an elongated roller member having a generally centrally located shaft extending from at least one end thereof, in that means mounting said shaft to said framework include vertical adjustment means on said shaft and said framework and in that said roller member is selectively rotatable about said shaft whereby the surface of said bearing surface in juxtaposition with said doctor blade is adjustable in circumferential direction to facilitate removal of contaminations which have accumulated thereon.

12. The laminating apparatus of claim 11 wherein said vertical adjustment means includes eccentric guide means on said shaft and said frame.

13. The laminating apparatus of claim 12 wherein said eccentric guide means includes a sleeve member positioned on a lateral section of said shaft, and wherein the outer cylindrical surface of said sleeve which is not coaxial to the inner surface thereof, is mounted in a complementary bore of a part which is fixed to said frame.

14. The laminating apparatus of claim 13 and further including indicator means associated with said shaft to indicate the relative position of said bearing surface with respect to said doctor blade.

15. A laminating apparatus for applying a coating to a web of sheet material wherein the web is drawn between an elongated doctor blade and an elongated bearing surface, said doctor blade and bearing surface being carried by a supporting framework for relative vertical movement whereby to vary the thickness of the applied coating, characterized in that said bearing surface has a convex curvature and in that means are provided for mounting said bearing surface on the supporting framework for vertical adjustment, wherein the doctor blade is vertically oriented and wherein the web to be coated is tangentially fed onto the convex bearing surface at a point thereof being situated streamup of the point of the bearing surface facing the doctor blade and wherein the coated web is withdrawn from the convex bearing surface at that point facing the doctor blade in generally horizontal direction.

16. The laminating apparatus of claim 15 wherein said bearing surface comprises an elongated roller member having a generally centrally located shaft extending from at least one end thereof, means mounting said shaft to said framework, said mounting means including vertical adjustment means on said shaft and said frame.

17. The laminating apparatus of claim 16 wherein said vertical adjustment means includes eccentric guide means on said shaft and said frame.

18. The laminating apparatus of claim 17 wherein said eccentric guide means includes a sleeve member positioned on a lateral section of said shaft, and wherein the outer cylindrical surface of said sleeve which is not coaxial to the inner surface thereof, is mounted in a complementary bore of a part which is fixed to said frame.

19. The laminating apparatus of claim 18 and further including indicator means associated with said shaft to indicate the relative position of said bearing surface with respect to said doctor blade.

20. The laminating apparatus of claim 15 wherein said roller member is selectively rotatable about said shaft whereby the surface of said bearing surface in juxtaposition with said doctor blade is horizontally adjustable.

21. The laminating apparatus of claim 15 wherein said roller is rotatably mounted on said shaft.

22. The laminating apparatus of claim 21 wherein said vertical adjustment means includes eccentric guide means on said shaft and said frame.

23. The laminating apparatus of claim 21 wherein said eccentric guide means includes a sleeve member positioned on a lateral section of said shaft, and wherein the outer cylindrical surface of said sleeve which is not coaxial to the inner surface thereof, is mounted in a complementary bore of a part which is fixed to said frame.

24. The laminating apparatus of claim 13 and further including indicator means associated with said shaft to indicate the relative position of said bearing surface with respect to said doctor blade.

* * * * *

UNITED STATES PATENT AND TRADEMARK OFFICE

CERTIFICATE OF CORRECTION

PATENT NO. : 4,241,697

DATED : December 30, 1980

INVENTOR(S) : Helmut A. Friz

It is certified that error appears in the above—identified patent and that said Letters Patent is hereby corrected as shown below:

Column 6, line 8, Claim 23:

"21" should be --22--

Column 6, line 16, Claim 24:

"13" should be --23--

Signed and Sealed this

*Fourth* Day of *August 1981*

[SEAL]

*Attest:*

GERALD J. MOSSINGHOFF

*Attesting Officer*

*Commissioner of Patents and Trademarks*